US010058738B1

(12) United States Patent
Wang

(10) Patent No.: US 10,058,738 B1
(45) Date of Patent: Aug. 28, 2018

(54) SWIMMING EQUIPMENT IMPROVEMENT

(71) Applicant: Ching-Wen Wang, New Taipei (TW)

(72) Inventor: Ching-Wen Wang, New Taipei (TW)

( * ) Notice: Subject to any disclaimer, the term of this patent is extended or adjusted under 35 U.S.C. 154(b) by 0 days.

(21) Appl. No.: 15/796,314

(22) Filed: Oct. 27, 2017

(51) Int. Cl.
*A63B 31/08* (2006.01)
*A63B 31/11* (2006.01)

(52) U.S. Cl.
CPC ..... *A63B 31/11* (2013.01); *A63B 2031/112* (2013.01); *A63B 2210/50* (2013.01)

(58) Field of Classification Search
CPC ..... A63B 31/11

See application file for complete search history.

(56) References Cited

U.S. PATENT DOCUMENTS 3,178,738 A * 4/1965 La Trell ..... A63B 31/11 36/100
3,302,222 A * 2/1967 Ferraro ..... A63B 31/11 441/64
3,521,312 A * 7/1970 Ganev ..... A63B 31/11 441/64
3,922,741 A * 12/1975 Semeia ..... A63B 31/11 425/129.1

* cited by examiner

*Primary Examiner* — Stephen P Avila
(74) *Attorney, Agent, or Firm* — Egbert Law Offices, PLLC

(57) ABSTRACT

An improved structure of swimming equipment includes a swim fin shoe body, a holder, an assembling slot and a straight swim fin board. Two ends of the swim fin shoe body are provided with a tip and a heel respectively. The tip of the swim fin shoe body extends at an angle towards the front and underside of the swim fin shoe body to form the holder, and the front end of the holder is provided with the assembling slot. Two ends of the straight swim fin board are provided with a paddling section and a detachable assembling section assembled in the assembling slot. The assembling section and paddling section form a straight pattern jointly, so that the straight swim fin board tilts towards the front and underside of the swim fin shoe body along with the holder.

4 Claims, 5 Drawing Sheets

SWIMMING EQUIPMENT IMPROVEMENT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a swimming equipment improvement, simplifying the structure and saving cost while conforming with human engineering of kicking swim fins, easily assembled and portable, and unlikely to be broken by the diver, and more particularly to the swim fin shoe body, holder, assembling slot and straight swim fin board of the swimming equipment improvement.

2. Description of Related Art Including Information Disclosed Under 37 CFR 1.97 and 37 CFR 1.98

The known long-board swim fin is usually assembled of a swim fin shoe body (or shoe cover) and a bending swim fin board (or long board). The traditional bending swim fin boards comprise plastic board, glass fiber board and carbon fiber board. As shown in FIG. 1, this type of bending swim fin board 2*a* is generally assembled at the bottom of swim fin shoe body 1, i.e. combined with the sole 102 of swim fin shoe body 1, the bending swim fin board 2*a* tilts down from the front end of the swim fin shoe body 1, thus when the diver is wearing the swim fin shoe body 1, the tilt angle between the bending swim fin board 2*a* and the sole of swim fin shoe body 1 can conform with human engineering of kicking swim fin, favorable for the diver's kicking swim fin and swimming efficiency. Therefore, there is a bending section 23*a* at the junction of the known bending swim fin board 2*a* and the sole of swim fin shoe body 1, so that when the bending swim fin board 2*a* is assembled at the sole 102 of swim fin shoe body 1 via the bending section 23*a*, the bending swim fin board 2*a* tilts down, and the bending section 23*a* of the bending swim fin board 2*a* is fixed to the sole 102 of swim fin shoe body 1 with screws or tenons.

However, when the known bending swim fin board 2*a* is equipped with the bending section 23*a*, the overall length is increased, and the bending section 23*a* has a tilt angle, it is relatively difficult to produce the bending swim fin board 2*a*. Furthermore, the known combination of swim fin shoe body 1 and bending swim fin board 2*a* is influenced by the tilt angle between them, the assembly is difficult. Therefore in general condition, when the swim fin shoe body 1 and bending swim fin board 2*a* are assembled, they are not to be disassembled, so that the overall length of the swim fin shoe body 1 and bending swim fin board 2*a* is very large, leading to low portability. In addition, when the swim fin shoe body 1 and bending swim fin board 2*a* are assembled, the bending section 23*a* of the bending swim fin board 2*a* is usually under the diver's sole (sole 102). This type of bending swim fin board 2*a* made of glass fiber or carbon fiber material is very brittle, very likely to be broken by the diver himself.

In view of this, the inventor accumulated related studies and practical experience over years, and created a swimming equipment improvement, so as to remedy the deficiencies in said known techniques.

BRIEF SUMMARY OF THE INVENTION

The primary objective of the present invention is to provide a swimming equipment improvement, comprising a swim fin shoe body with a tip end and a heel end; the tip of the swim fin shoe body tilts and extends towards the front and underside of the swim fin shoe body to form a holder, and there is an assembling slot in the front end of the holder; and a straight swim fin board, provided with a paddling section on both ends respectively, and a detachable assembling section assembled in the assembling slot. The assembling section and paddling section form a straight pattern, so that the straight swim fin board tilts towards the front and underside of the swim fin shoe body along with the holder. The tilt angle between the straight swim fin board and swim fin shoe body conforms with human engineering of kicking swim fin, and the structure of the straight swim fin board is simplified, the cost is reduced, and it is easy to assemble the swim fin shoe body and straight swim fin board, multiple straight swim fin boards can be carried and assembled on site. In addition, the straight swim fin board is assembled in the front of the diver's sole, not trampled under the sole, so it is unlikely to be broken, remedying the deficiencies in the known bending swim fin board, such as difficult production and assembly, low portability, and the bending section of the known bending swim fin board is under the sole, very easy to be broken.

According to said main structural features, the assembling slot opens towards the front of the holder, the assembling slot is provided with a wall towards the underside of the holder; or the assembling slot opens towards the front and underside of the holder.

According to said main structural features, the holder and straight swim fin board are separated from the sole of the swim fin shoe body at 5 to 30°.

In order to disclose the present invention clearly and completely, the preferred implementation is illustrated, so as to expound the implementation mode.

DETAILED DESCRIPTION OF THE INVENTION

Figure 1:
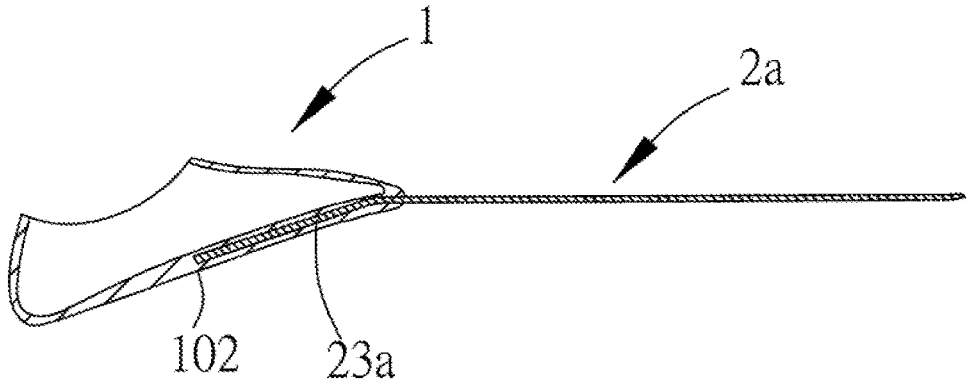
FIG. 1 is a sectional view of the known long-board swim fin.
Figure 2:
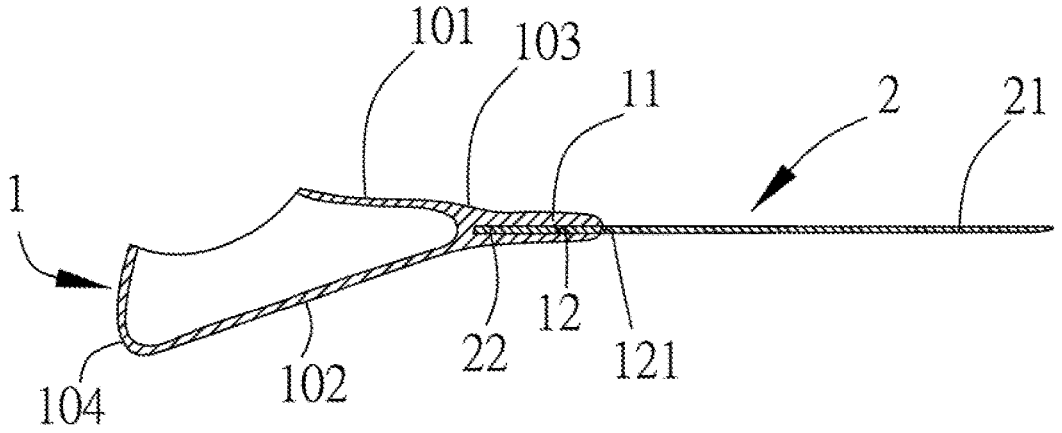
FIG. 2 is a sectional view of the preferred embodiment of the present invention.

FIG. 2 discloses the implementation mode of the present invention. Said figure describes the swimming equipment improvement of the present invention, comprising a swim fin shoe body 1, a holder 11, an assembling slot 12 and a straight swim fin board 2. The swim fin shoe body 1 has a top surface 101 and a sole 102, and a tip 103 and a heel 104 are located in both ends of swim fin body 1 respectively.

In the preferred embodiment adopted, the tip 103 of the swim fin shoe body 1 tilts and extends towards the front and underside of the swim fin shoe body 1 to form the holder 11, and the front end of the holder 11 is provided with the assembling slot 12, so that the included angle from the holder 11 and assembling slot 12 to the sole 102 of the swim fin shoe body 1 is 5 to 30°, and the slot opening 121 of the assembling slot 12 opens towards the front of the holder 11. Two ends of the straight swim fin board 2 are provided with a paddling section 21 and a detachable assembling section 22 assembled in the assembling slot 12 respectively. The assembling section 22 and paddling section 21 form a straight pattern jointly.

The assembling section 22 of the straight swim fin board 2 can be inserted in the assembling slot 12 through the slot opening 121 at the front end of the holder 11, and the assembling section 22 of the straight swim fin board 2 is fixed to the assembling slot 12 of swim fin shoe body 1 with screws, tenons or similar structures, so that the straight swim fin board 2 tilts towards the front and underside of the swim fin shoe body 1 along with the holder 11, the included angle between the straight swim fin board 2 and the sole 102 of the swim fin shoe body 1 is 5 to 30°. Therefore, the tilt angle between the straight swim fin board 2 and swim fin shoe body 1 conforms with human engineering of kicking swim fin, and the structure of the straight swim fin board 2 is simplified, saving the production cost, and it is easy to assemble the swim fin shoe body 1 and straight swim fin board 2, favorable for carrying multiple straight swim fin boards 2 to the diving site. In addition, the straight swim fin board 2 is assembled in the front of the diver's sole, not trampled under the sole, it is unlikely to be broken. When the straight swim fin board 2 is to be changed by another material, the assembling section 22 of the straight swim fin board 2 can be drawn out of the assembling slot 12 easily, so as to disassemble the straight swim fin board 2 rapidly.

Figure 3:
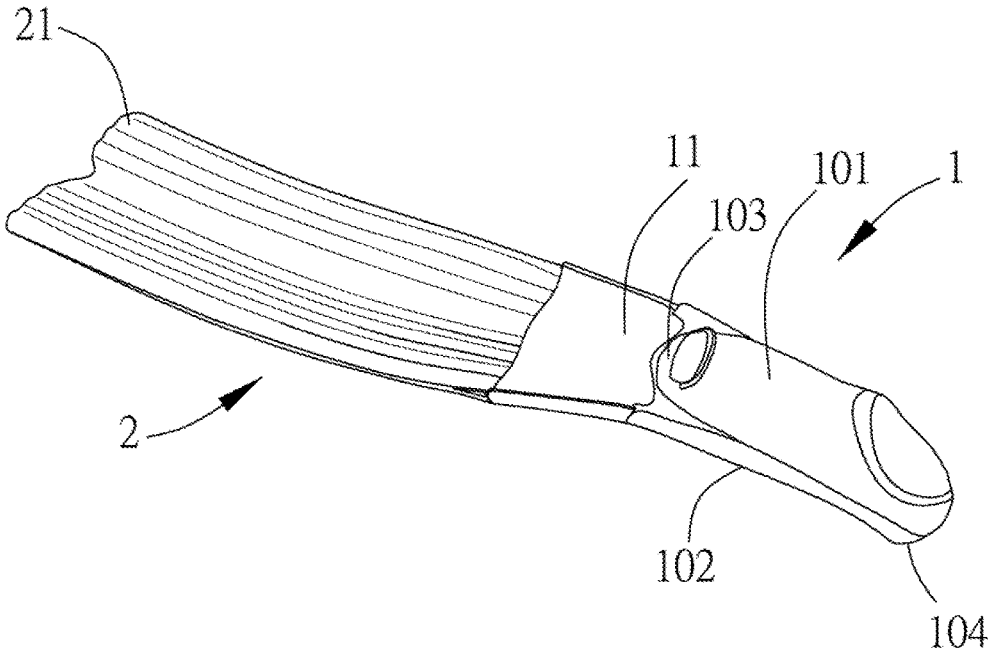
FIG. 3 is a stereogram of a feasible embodiment in FIG. 2.
Figure 4:
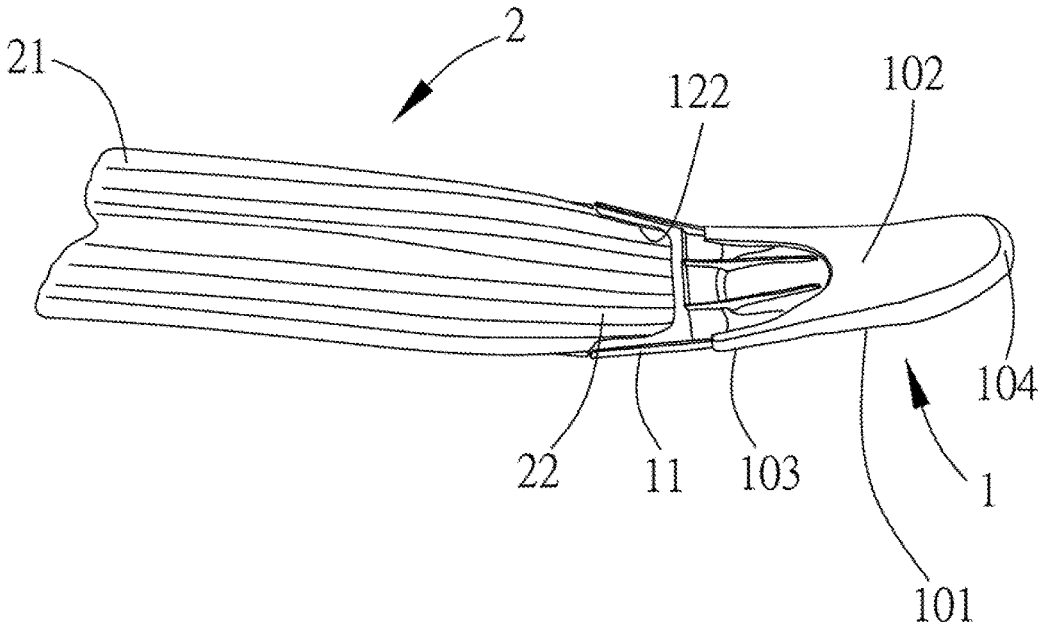
FIG. 4 is a stereogram of the bottom in FIG. 3.
Figure 5:
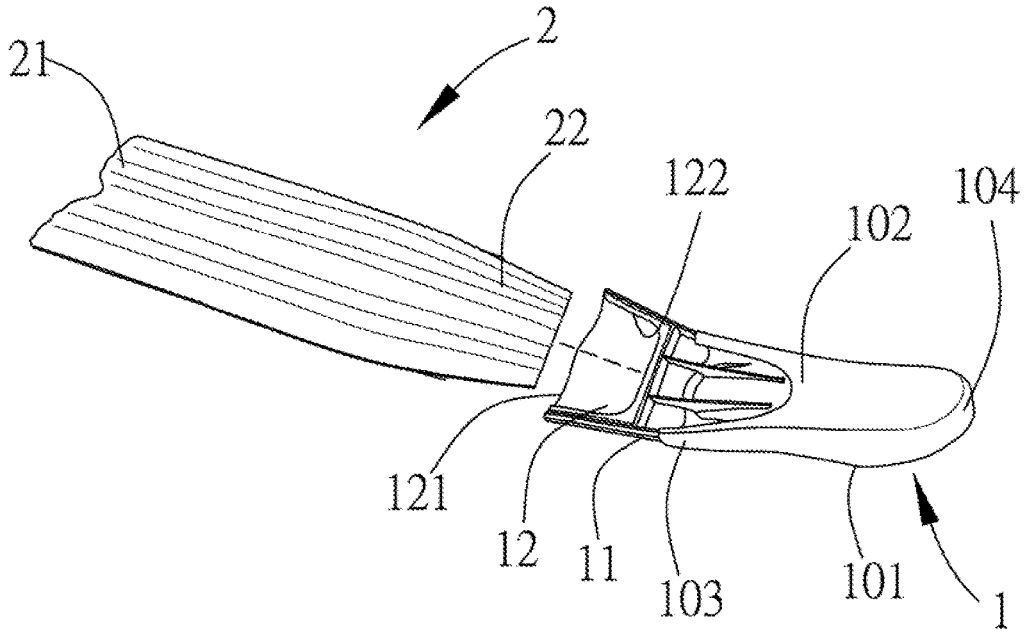
FIG. 5 is a three-dimensional exploded diagram of FIG. 4

FIGS. 3 to 5 show in a feasible embodiment, the slot opening 121, 122 of assembling slot 12 of the holder 11 can open towards the front and underside of the holder 11.

Figure 6:
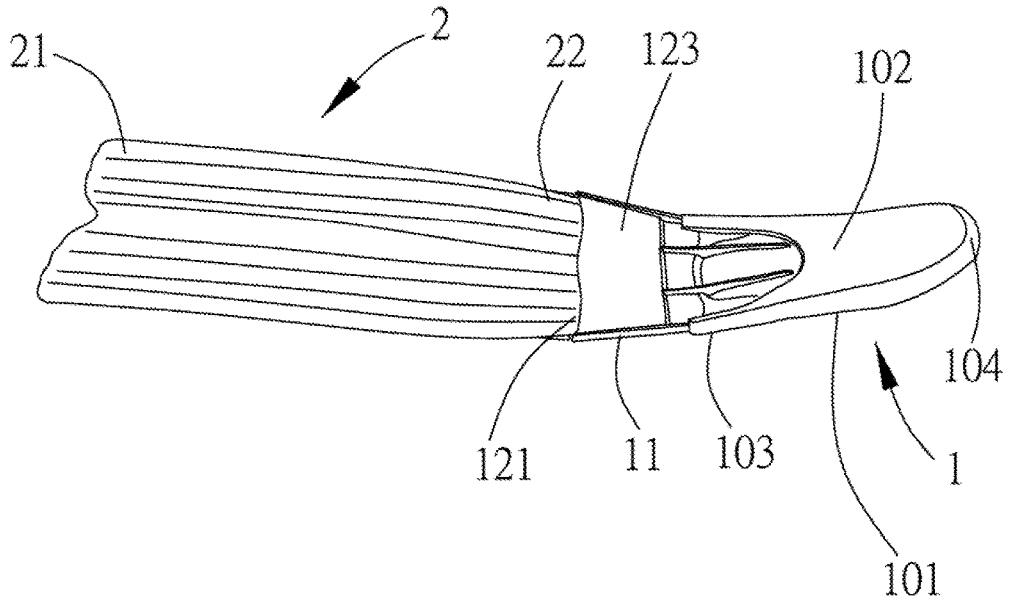
FIG. 6 is a stereogram of the bottom of a corrected embodiment in FIG. 4.

FIG. 6 shows in a modified embodiment, the assembling slot 12 of the holder 11 is provided with a forward slot opening 121, the downward slot opening 122 of the assembling slot 12 is omitted (as shown in FIGS. 4 and 5), and there is a wall 123 for closing the slot opening 122 in the position of the assembling slot 12 facing towards the underside of the holder 11.

In comparison to previous techniques, the present invention has the following advantages.

First, the holder 11 and assembling slot 12 are located in the front end of tip 103 of the swim fin shoe body 1 at an angle, so that the straight swim fin board 2 is free of the bending section of the known bending swim fin board, the overall length of the straight swim fin board 2 can be shorter than the known bending swim fin board, enhancing portability.

Next, as the straight swim fin board 2 is a straight form composed of the assembling section 22 and paddling section 21, the overall structure is flat and simple, the structural complexity is reduced a lot, and the production cost is reduced.

Next, it is easy to assemble the straight swim fin board 2 with the assembling slot 12 of holder 11, the straight swim fin board 2 can be assembled or disassembled easily, favorable for trips.

Next, as the straight swim fin board 2 and swim fin shoe body 1 can be assembled easily, multiple straight swim fin boards 2 of different materials (e.g. plastic, glass fiber and carbon fiber boards) and rigidities can be carried simultaneously, so as to choose the straight swim fin board 2 of any material and rigidity according to the flow intensity on the diving site (e.g. lakeside, seaside), and the assembly can be done rapidly on the diving site.

Finally, as the assembling section 22 of the straight swim fin board 2 is located in the front end of tip 103 of the swim fin shoe body 1, whereas the bending section of the known bending swim fin board is located under the diver's sole, if the straight swim fin board 2 made of glass fiber or carbon fiber material is used, the straight swim fin board 2 and assembling section 22 will not be broken by trampling.

The above is only the preferred embodiment of the present invention, it may not limit the applicable range of the present invention, any changes and modifications which can be done apparently by the persons familiar with this industry shall be regarded as substantial content not departing from the present invention.

I claim:

1. A swimming fin assembly comprising:

a swim fin shoe body having an elongated tip at a forward end thereof and a heel at a rearward end thereof, said swim fin shoe body having a sole extending between said elongated tip and said heel, said elongated tip extending at an angle relative to said sole, said elongated tip having a linear assembling slot opening at an end of said elongated tip opposite said sole, said linear assembling slot being entirely forward of said sole; and a straight swim fin board having a paddling section and a detachable assembling section, said detachable assembling section being linear and received in said linear assembling slot, said paddling section and said detachable assembling section being aligned in a straight orientation, said straight swim fin board being tilted with respect to said sole of said swim fin shoe body.

2. The swimming fin assembly of claim 1, said linear assembling slot having a wall facing an underside of said elongated tip.

3. The swimming fin assembly of claim 1, said linear assembling slot opening at an underside of said elongated tip.

4. The swimming fin assembly of claim 1, said straight swim fin board being at an included angle of 5° to 30° with respect to said sole of said swim fin shoe body.

* * * * *